US008157545B2

(12) United States Patent
Okamoto

(10) Patent No.: US 8,157,545 B2
(45) Date of Patent: Apr. 17, 2012

(54) HERMETIC COMPRESSOR AND METHOD OF MANUFACTURING THE SAME

(75) Inventor: Takayuki Okamoto, Shiga (JP)

(73) Assignee: Panasonic Corporation, Osaka (JP)

( * ) Notice: Subject to any disclaimer, the term of this patent is extended or adjusted under 35 U.S.C. 154(b) by 409 days.

(21) Appl. No.: 12/515,097

(22) PCT Filed: Oct. 27, 2008

(86) PCT No.: PCT/JP2008/003046

§ 371 (c)(1),
(2), (4) Date: May 15, 2009

(87) PCT Pub. No.: WO2009/098742

PCT Pub. Date: Aug. 13, 2009

(65) Prior Publication Data

US 2011/0064563 A1 Mar. 17, 2011

(30) Foreign Application Priority Data

Feb. 7, 2008 (JP) ..... 2008-027465

(51) Int. Cl.
*F03B 11/00* (2006.01)

(52) U.S. Cl. ..... 417/415

(58) Field of Classification Search ..... 417/415, 417/423.1

See application file for complete search history.

(56) References Cited

U.S. PATENT DOCUMENTS 7,144,229 B2 12/2006 Ishida et al.
2006/0147326 A1 7/2006 Kakiuchi et al.

FOREIGN PATENT DOCUMENTS

JP 2000-291551 A 10/2000
JP 2001-317460 A 11/2001
JP 2003-028065 A 1/2003

OTHER PUBLICATIONS

International Search Report issued Feb. 25, 2009 in International application No. PCT/JP2008/003046, 4 pages.
Written Opinion of the International Searching Authority issued Feb. 25, 2009 in International application No. PCT/JP2008/003046, 7 pages.

*Primary Examiner* — Karabi Guharay
*Assistant Examiner* — Elmito Breval
(74) *Attorney, Agent, or Firm* — Brinks Hofer Gilson & Lione

(57) ABSTRACT

A hermetic compressor includes a hermetic container arranged to store lubricating oil, a motor element accommodated in the hermetic container, an oil-feeding mechanism arranged to carry the lubricating oil, and a centrifugal pump arranged to carry the lubricating oil to the oil-feeding mechanism. The centrifugal pump includes a cylindrical portion having a hollow opening at the opening, and an aperture plate having a suction aperture formed therein. The aperture plate has an inner edge facing the suction aperture, and an outer edge of the aperture plate contacting an inner surface of the cylindrical portion. A portion of the aperture plate between the inner edge and the outer edge of the aperture plate is positioned more outward from the cylindrical portion than the inner edge and the outer edge are. This hermetic compressor does not produce fine metal powder during manufactured, having high reliability.

12 Claims, 5 Drawing Sheets

[Fig. 1]
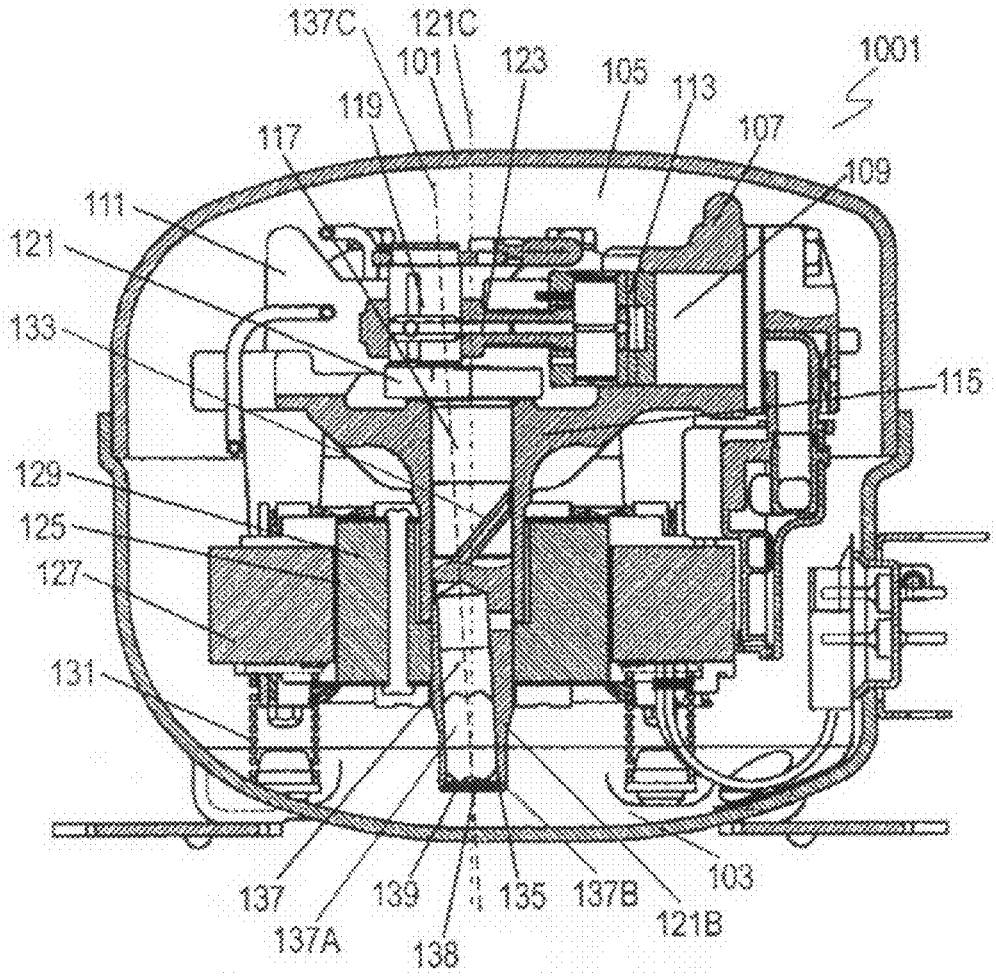
[Fig. 2A]
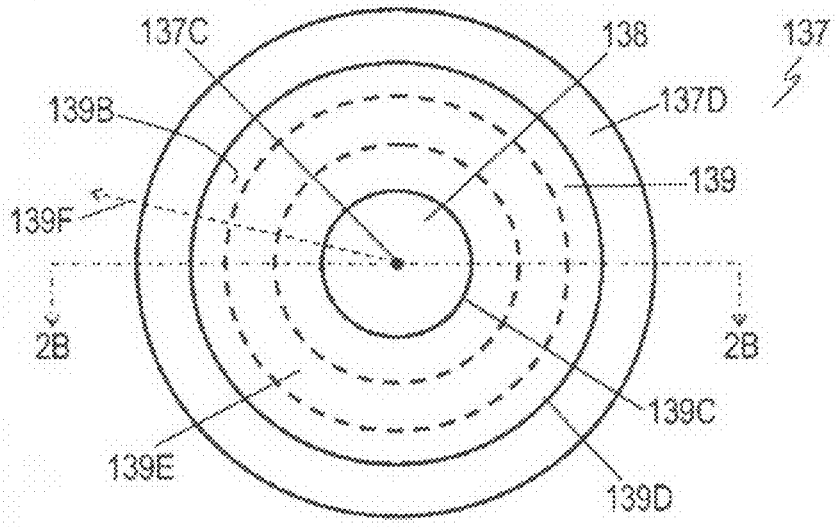

[Fig. 2B]
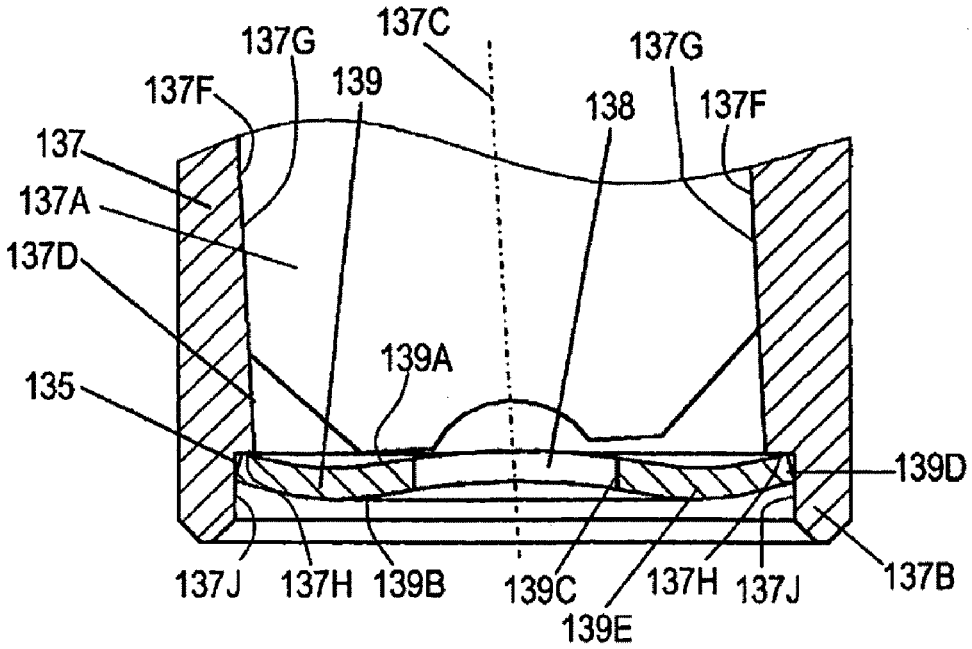
[Fig. 2C]
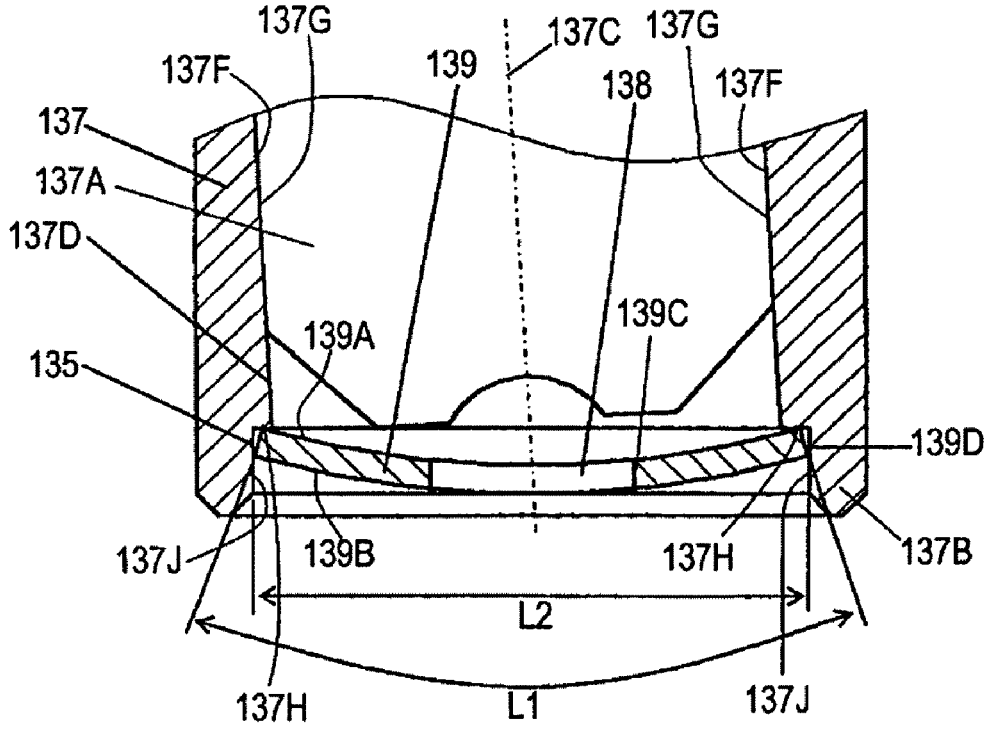

[Fig. 3A]
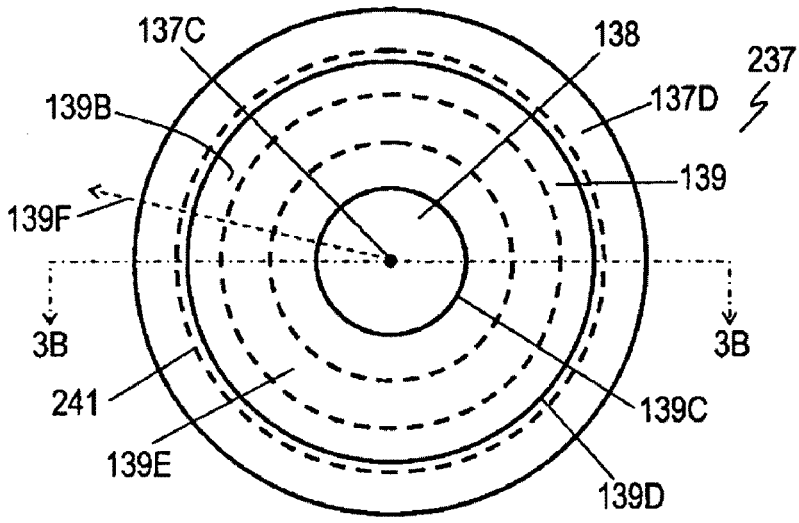
[Fig. 3B]
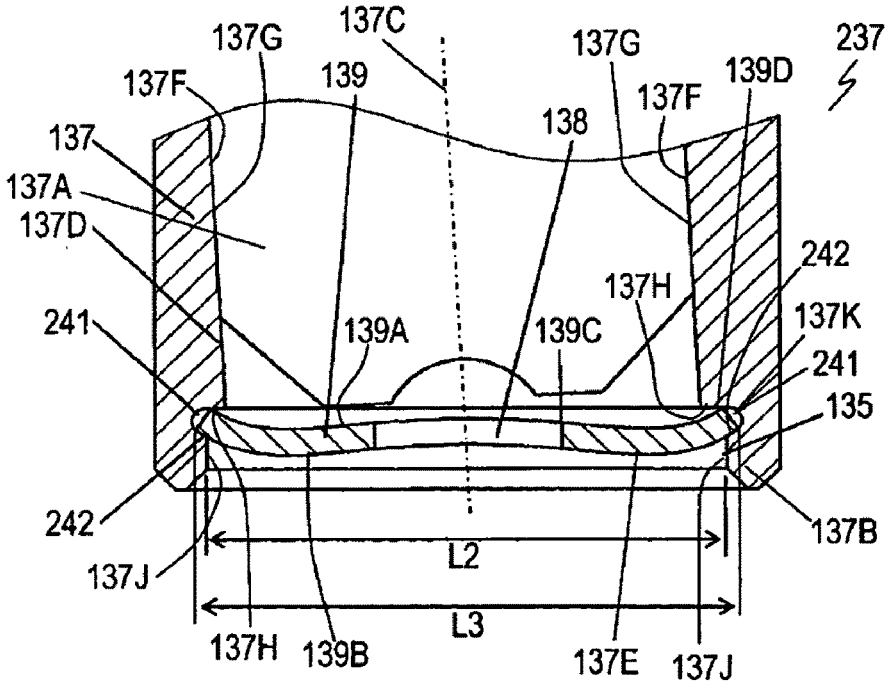

[Fig. 3C]
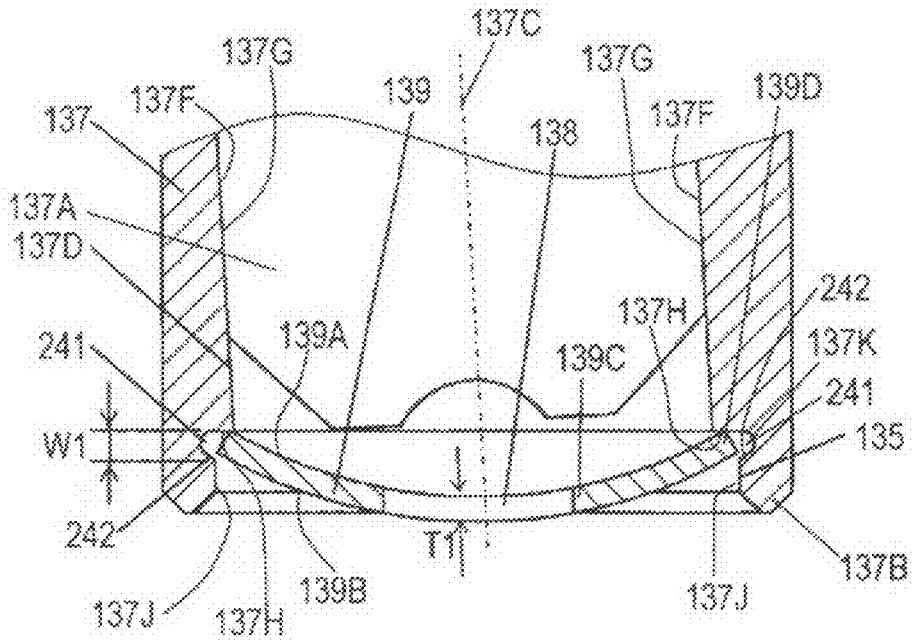
[Fig. 4]
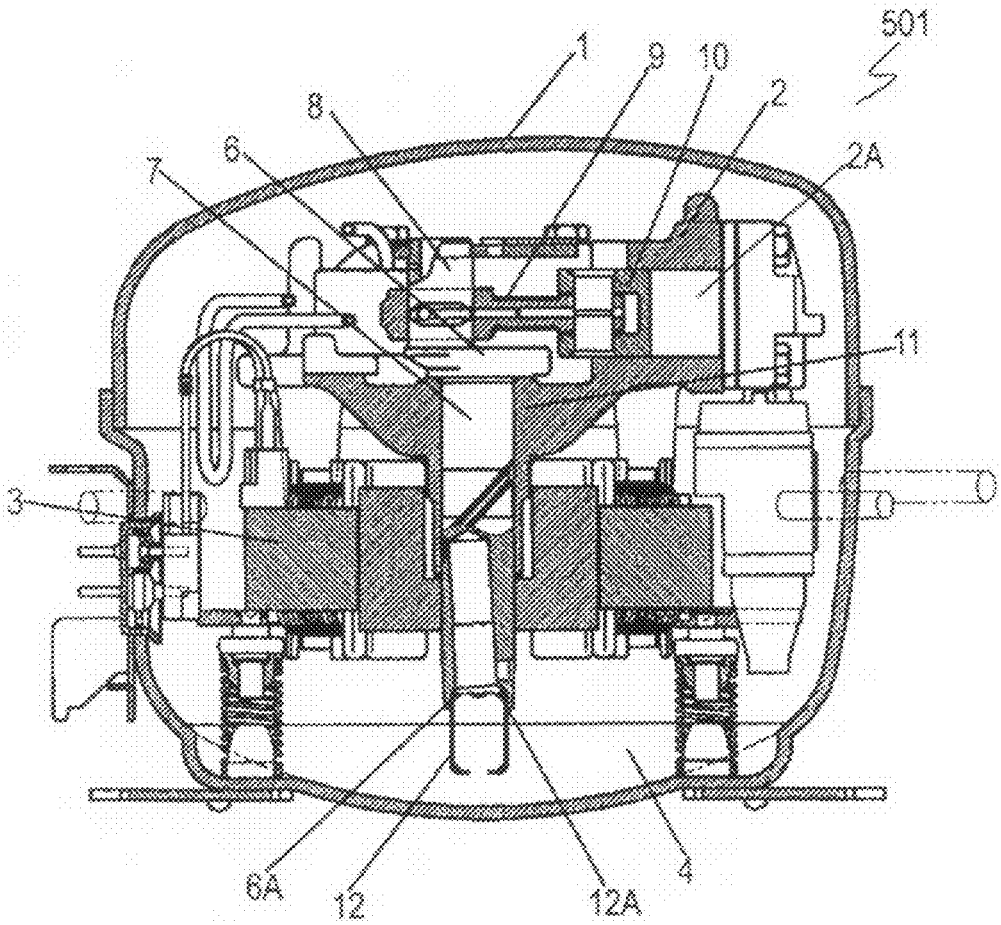

[Fig. 5A]
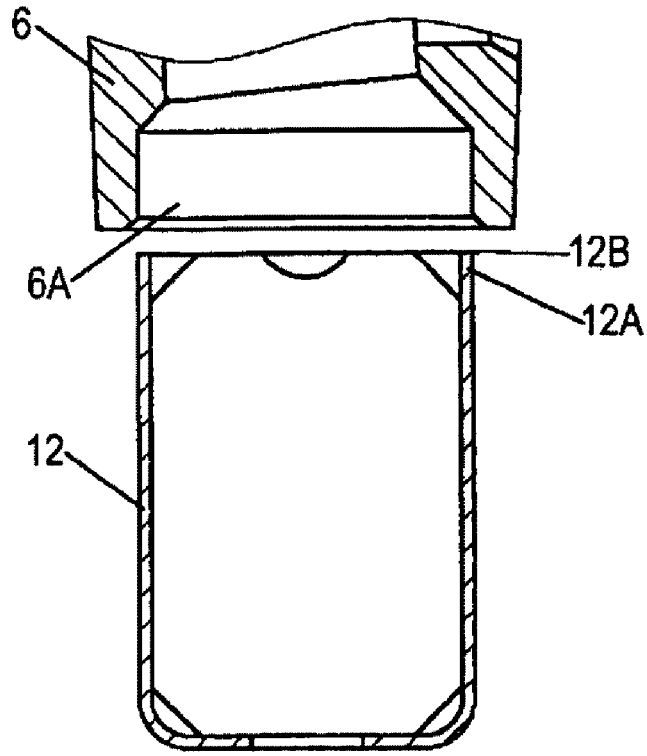
[Fig. 5B]
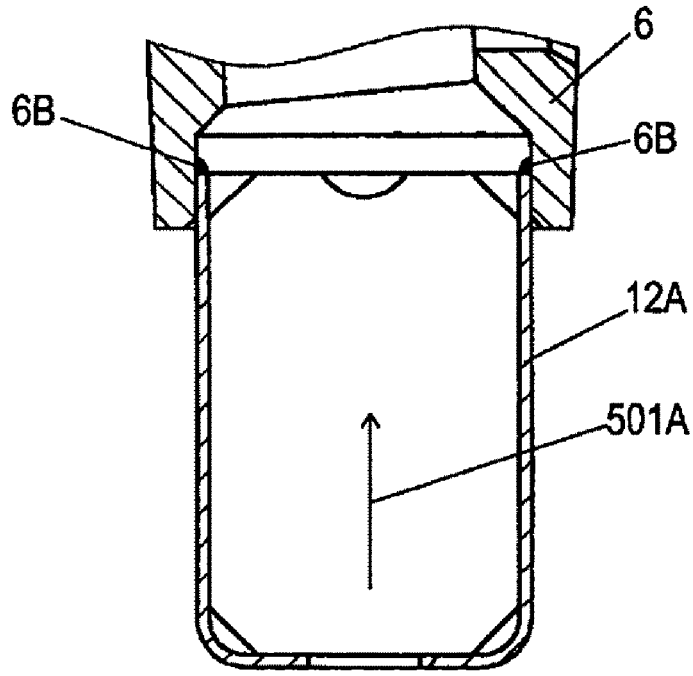

HERMETIC COMPRESSOR AND METHOD OF MANUFACTURING THE SAME

This application is a 371 application of PCT/JP2008/003046 having an international filing date of Oct. 27, 2008, which claims priority to JP2008-27465 filed on Feb. 7, 2008, the entire contents of which are incorporated herein by reference.

BACKGROUND

1. Technical Field

The present invention relates to a hermetic compressor used in a freezer, such as a home refrigerator, and to a method of manufacturing the compressor.

2. Background Art

A hermetic motor-driven compressor used in a freezer, such as a home refrigerator, has been demanded to have a small power consumption, small noises, low cost, and high reliability.

FIG. 4 is a sectional view of conventional hermetic compressor 501 described in patent citation 1. Hermetic container 1 accommodates compressing element 2 and motor element 3 therein. The lower portion of hermetic container 1 stores lubricating oil 4. Shaft 6 includes main shaft 7 and eccentric shaft 8. Eccentric shaft 8 of shaft 6 is coupled to piston 10 via connecting rod 9. Main shaft 7 is supported by bearing 11. A lower end of shaft 6 has opening 6A formed therein. Inserting part 12A of oil-feeding pipe 12 is press-fitted and fixed into opening 6A. A tip end of oil-feeding pipe 12 opens to lubricating oil 4. Oil-feeding pipe 12 is formed by press-molding metal.

An operation of hermetic compressor 501 will be described. The rotation of motor element 3 is converted to a reciprocating movement by eccentric shaft 8 and connecting rod 9 of compressing element 2. Connecting rod 9 causes piston 10 to reciprocate in cylinder 2A to compress refrigerant. Motor element 3 rotates shaft 6 to rotate oil-feeding pipe 12. Oil-feeding pipe 12 having the tip end opening to lubricating oil 4 rotates to generate a pressure in oil-feeding pipe 12 by centrifugal pump effects. This pressure causes lubricating oil 4 to be sucked to oil-feeding pipe 12 and supplies the sucked oil to sliding parts of compressing element 2 from a top end of shaft 6.

FIGS. 5A and 5B are enlarged sectional views of shaft 6 and oil-feeding pipe 12 for illustrating a method of assembling shaft 6 and oil-feeding pipe 12. FIG. 5A shows shaft 6 and oil-feeding pipe 12 before assembled. FIG. 5B shows shaft 6 and oil-feeding pipe 12 after assembled. As described above, oil-feeding pipe 12 is formed by press-molding metal. Tip-end outer circumference 12B of inserting part 12A of oil-feeding pipe 12 may not be chamfered, or burrs produced at tip-end outer circumference 12B may not be eliminated adequately. In these cases, when inserting part 12A of oil-feeding pipe 12 is press-fitted into opening 6A of shaft 6, tip-end outer circumference 12B of inserting part 12A of oil-feeding pipe 12 made of metal grinds opening 6A of shaft 6 made of metal, possibly producing fine metal powder 6B.

Fine metal powder 6B is produced after oil-feeding pipe 12 is fixed to shaft 6, and hence, metal powder 6B can hardly be removed completely even upon being cleaned, thus remaining inside opening 6A of shaft 6. Fine metal powder 6B which remains is carried to the sliding parts of compressing element 2 together with lubricating oil 4 flowing in direction 501A when compressor 501 operates. Fine metal powder 6B caught in the sliding parts of compressing element 2 may stop compressor 501.

Patent Citation 1

Japanese Patent Laid-Open Publication No. 2001-317460

DISCLOSURE OF INVENTION

A hermetic compressor includes a hermetic container arranged to store lubricating oil, a motor element accommodated in the hermetic container, an oil-feeding mechanism arranged to carry the lubricating oil, and a centrifugal pump arranged to carry the lubricating oil to the oil-feeding mechanism. The centrifugal pump includes a cylindrical portion having a hollow opening at the opening, and an aperture plate having a suction aperture formed therein. The aperture plate has an inner edge facing the suction aperture, and an outer edge of the aperture plate contacting an inner surface of the cylindrical portion. A portion of the aperture plate between the inner edge and the outer edge of the aperture plate is positioned more outward from the cylindrical portion than the inner edge and the outer edge are.

This hermetic compressor does not produce fine metal powder during manufactured, having high reliability.

BRIEF DESCRIPTION OF THE DRAWINGS

FIG. 1 is a side sectional view of a hermetic compressor according to an exemplary embodiment of the present invention.

FIG. 2A is an enlarged plan view of a centrifugal pump of the hermetic compressor according to the embodiment.

FIG. 2B is a sectional view of the centrifugal pump at line 2B-2B shown in FIG. 2A.

FIG. 2C is a sectional view of the centrifugal pump shown in FIG. 2B for illustrating a method of manufacturing the centrifugal pump.

FIG. 3A is an enlarged plan view of another centrifugal pump of the hermetic compressor according to the embodiment.

FIG. 3B is a sectional view of the centrifugal pump at line 3B-3B shown in FIG. 3A.

FIG. 3C is a sectional view of the centrifugal pump shown in FIG. 3B for illustrating a method of manufacturing the centrifugal pump.

FIG. 4 is a side sectional view of a conventional hermetic compressor.

FIG. 5A is an enlarged sectional view of a conventional shaft.

FIG. 5B is an enlarged sectional view of the conventional shaft.

EXPLANATION OF REFERENCE

101 Hermetic Container
103 Lubricating Oil
107 Compressing Element
109 Compression Chamber
111 Cylinder Block
115 Bearing
117 Main Shaft
119 Eccentric Shaft
121 Shaft
121C Rotation Axis
125 Motor Element
133 Oil-feeding Mechanism
135 Opening
137 Centrifugal Pump
137A Hollow
137C Center Axis

137D Cylindrical portion
138 Suction Aperture
139 Aperture Plate
139C Inner Edge
139D Outer Edge
137 Centrifugal Pump
241 Groove
242 Slope

BEST MODE FOR CARRYING OUT THE INVENTION

FIG. 1 is a sectional view of hermetic compressor 1001 according to an exemplary embodiment of the present invention. Hermetic container 101 is arranged to store lubricating oil 103 and to be filled with refrigerant gas 105. Compressing element 107 is a compressing element of a reciprocating-type including cylinder block 111 defining compression chamber 109, piston 113 inserted into compression chamber 109 to reciprocate in the chamber, shaft 121 pivotally supported by bearing 115 of cylinder block 111, and connecting rod 123 connecting shaft 121 with piston 113. Shaft 121 includes main shaft 117 and eccentric shaft 119. Connecting rod 123 couples eccentric shaft 119 of shaft 121 with piston 113. Shaft 121 rotates about rotation axis 121C.

Motor element 125 is driven by an inverter circuit, and includes stator 127 fixed beneath cylinder block 111 and rotor 129 fixed to main shaft 117. Stator 127 is arranged to be connected to the inverter circuit. Rotor 129 includes a permanent magnet. Spring 131 is fixed to stator 127, and elastically fixes compressing element 107 and motor element 125 to hermetic container 101.

Shaft 121 includes oil-feeding mechanism 133 carrying lubricating oil 103 upward. Oil-feeding mechanism 133 is constituted by a groove provided between main shaft 117 and bearing 115. Oil-feeding mechanism 133 communicates with centrifugal pump 137 provided at lower end 121B of shaft 121. Centrifugal pump 137 has lower end 137B arranged to be positioned in lubricating oil 103. Lower end 137B has opening 135 which is formed therein and which is arranged to be positioned in lubricating oil 103. Centrifugal pump 137 includes cylindrical portion 137D and aperture plate 139. Cylindrical portion 137D has substantially a cylindrical shape, and has hollow 137A and opening 135 opening to lubricating oil 103. Hollow 137A opens at opening 135. Aperture plate 139 is provided at opening 135 of cylindrical portion 137D. Aperture plate 139 has suction aperture 138 formed therein. Suction aperture has a cross-sectional area smaller than that of hollow 137A. Suction aperture 138 is positioned on rotation axis 121C of shaft 121. Hollow 137A extends upward from suction aperture 138 along center axis 137C which inclines apart from rotation axis 121C.

FIG. 2A is a bottom plan view of centrifugal pump 137. FIG. 2B is a sectional view of centrifugal pump 137 at line 2B-2B shown in FIG. 2A.

Cylindrical portion 137D of centrifugal pump 137 has inner surface 137F facing hollow 137A. Inner surface 137F of cylindrical portion 137D includes small-diameter part 137G positioned at the upper part of cylindrical portion 137D, step surface 137H connected with small-diameter part 137G, and large-diameter part 137J connected with step surface 137H. Step surface 137H is directed towards opening 135. Large-Diameter part 137J has a diameter larger than that of small-diameter part 137G.

Aperture plate 139 has suction aperture 138 provided therein, and has substantially an annular plate shape. Aperture plate 139 is made of a metal plate, such as a hot-rolled steel plate or cold-rolled steel plate, plastically deformable, and is formed by punching the metal plate with a mold. Aperture plate 139 has upper surface 139A facing hollow 137A of cylindrical portion 137D and lower surface 139B opposite to upper surface 139A. Lower surface 139B of aperture plate 139 is directed in direction 137E towards the outside of cylindrical portion 137D, namely, is directed downward. Aperture plate 139 has inner edge 139C facing suction aperture 138 and outer edge 139D contacting cylindrical portion 137D. Outer edge 139D of aperture plate 139 contacts step surface 137H and large-diameter part 137J out of inner surface 137F of cylindrical portion 137D.

As shown in FIG. 2B, the cross section of aperture plate 139 along radial direction 139F extending perpendicularly to center axis 137C of hollow 137A is curved. Specifically, portion 139E between inner edge 139C and outer edge 139D is positioned more outward from cylindrical portion 137D along center axis 137C than inner edge 139C and outer edge 139D of aperture plate 139. That is, lower surface 139B of aperture plate 139 projects along center axis 137C outward from cylindrical portion 137D between inner edge 139C and outer edge 139D. Upper surface 139A is concavely curved outward from cylindrical portion 137D along center axis 137C between inner edge 139C and outer edge 139D.

FIG. 2C is a sectional view of centrifugal pump 137 of hermetic compressor 1001 for illustrating a method of manufacturing centrifugal pump 137 of hermetic compressor 1001, and shows aperture plate 139 before being fixed to cylindrical portion 137D. Before being fixed to cylindrical portion 137D, upper surface 139A of aperture plate 139 is a concave surface concave towards an outside of cylindrical portion 137D. Lower surface 139B is a convex surface projecting outward from cylindrical portion 137D. Suction aperture 138 is positioned at a bottom of upper surface 139A (the concave surface) and at a top of lower surface 139B (the convex surface). Aperture plate 139 is inserted into opening 135 of cylindrical portion 137D such that upper surface 139A faces hollow 137A, and outer edge 139D contacts step surface 137H. Then, upon being pressed near a center portion of lower surface 139B toward hollow 137A, aperture plate 139 plastically deforms and pressure-contacts the cylindrical portion to be fixed to opening 135, while outer edge 139D of aperture plate 139 is supported on step surface 137H.

Length L1 of aperture plate 139 along lower surface 139B before the plastic deformation is longer than diameter L2 of large-diameter part 137J which is an inner diameter of opening 135. The plastic deformation of aperture plate 139 allows outer edge 139D of aperture plate 139 to reliably pressure-contact large-diameter part 137J of inner surface 137F of cylindrical portion 137D at opening 135. The amount of the deformation of aperture plate 139 may be adjusted to easily adjust a force with which cylindrical portion 137D pressure-contacts the cylindrical portion. Thus aperture plate 139 pressure-contacts inner surface 137F of cylindrical portion 137D with a large force, thereby being prevented from removing and dropping from opening 135.

An operation of hermetic compressor 1001 will be described below.

When stator 127 of motor element 125 is energized by an inverter circuit, rotor 129 rotates shaft 121 and eccentrically rotates eccentric shaft 119. The eccentric rotation of eccentric shaft 119 is transferred to piston 113 via connecting rod 123. Then, piston 113 reciprocates in compression chamber 109 to compress refrigerant gas 105 which has inhaled. Upon rotating, shaft 121 rotates centrifugal pump 137, and causes lubricating oil 103 stored in hermetic container 101 to be sucked into hollow 137A of cylindrical portion 137D of centrifugal pump 137 through suction aperture 138 of aperture plate 139.

Suction aperture 138 is positioned on rotation axis 121C of shaft 121. Hollow 137A extends upward from suction aperture 138 along center axis 137C inclining depart from rotation axis 121C. When centrifugal pump 137 rotates about rotation axis 121C, lubricating oil 103 in hollow 137A receives a force directed upward along center axis 137C of hollow 137A of cylindrical portion 137D by a centrifugal force. This upward force moves lubricating oil 103 in hollow 137A upward to the top end of shaft 121 through oil-feeding mechanism 133, then, scattering the oil. Lubricating oil 103 which is moved and scattered is supplied to sliding parts of motor element 125 and compressing element 107.

According to the embodiment, aperture plate 139 is fixed to opening 135 by a pressure-contact force caused by the plastic deformation, and therefore, does not produce fine metal powder even upon being fixed to opening 135. Thus, the fine metal powder is not mixed into lubricating oil 103 sucked into hollow 137A of centrifugal pump 137, and does not reach the sliding parts of motor element 125 and compressing element 107. This prevents compressing element 107 from locking, thus providing hermetic compressor 1001 with high reliability.

FIG. 3A is a bottom plan view of another centrifugal pump 237 according to the embodiment. FIG. 3B is a sectional view of centrifugal pump 237 at line 3B-3B shown in FIG. 3A. In FIGS. 3A and 3B, components identical to those of centrifugal pump 137 shown in FIGS. 2A and 2B are denoted by the same reference numerals, and their description will be omitted.

As shown in FIG. 3B, in centrifugal pump 237, groove 241 is provided in corner 137K at which step surface 137H of inner surface 137F of cylindrical portion 137D is connected to large-diameter part 137J. Inner surface 137F of cylindrical portion 137D has slope 242 which is provided at groove 241 and which faces step surface 137H. Slope 242 is located closer to opening 135 than step surface 137H is. Outer edge 139D of aperture plate 139 contacts step surface 137H and groove 241, is sandwiched between step surface 137H and slope 242, and is inserted into groove 241.

FIG. 3C is a sectional view of centrifugal pump 237 of hermetic compressor 1001 for illustrating a method of manufacturing centrifugal pump 237, and shows aperture plate 139 before fixed to cylindrical portion 137D. Similarly to centrifugal pump 137 shown in FIG. 2C, aperture plate 139 is inserted into opening 135 of cylindrical portion 137D such that upper surface 139A faces hollow 137A, and outer edge 139D contacts step surface 137H. Then, upon being pressed near a center portion of lower surface 139B toward hollow 137A, aperture plate 139 plastically deforms and pressure-contacts the cylindrical portion to be fixed to opening 135, while outer edge 139D of aperture plate 139 is supported on step surface 137H.

As shown in FIGS. 3A and 3B, the diameter of aperture plate 139 is determined so that diameter L2 of large-diameter part 137J of inner surface 137F of cylindrical portion 137D is smaller than external diameter L3 of aperture plate 139 after the plastic deformation. Width W1 of groove 241 along center axis 137C is slightly larger than thickness T1 of aperture plate 139. This arrangement causes outer edge 139D of aperture plate 139 which has plastically deformed to be inserted into groove 241 and to contact slope 242 of groove 241. This arrangement allows aperture plate 139 to reliably pressure-contact inner surface 137F of cylindrical portion 137D at opening 135. The amount of the deformation of aperture plate 139 may be adjusted to adjusting a force with which cylindrical portion 137D pressure-contacts the cylindrical portion. Thus, aperture plate 139 pressure-contacts inner surface 137F of cylindrical portion 137D with a large force, thereby being prevented from removing and dropping from opening 135. Outer edge 139D of aperture plate 139 is inserted into groove 241 so that outer edge 139D of aperture plate 139 contacts slope 242 of groove 241 and step surface 137H of cylindrical portion 137D. This arrangement prevents aperture plate 139 from dropping from opening 135. Even while compressor 1001 operates, aperture plate 139 is reliably retained in groove 241. Thus, centrifugal pump 237 sucks lubricating oil 103 into hollow 137A stably as to supply lubricating oil 103 to the sliding parts of motor element 125 and compressing element 107.

Diameter L2 of large-diameter part 137J of inner surface 137F of cylindrical portion 137D is determined to be smaller than external diameter L3 of aperture plate 139 after the plastic deformation. Even if a force with which aperture plate 139 press-contacts inner surface 137F weakens after the deformation, aperture plate 139 is prevented from removing and dropping from opening 135, thereby allowing centrifugal pump 237 to suck lubricating oil 103 into hollow 137A. Hermetic compressor 1001 including centrifugal pump 237 thus has high reliability.

Width W1 of groove 241 is slightly larger than thickness T1 of aperture plate 139. This arrangement allows aperture plate 139 to deform while outer edge 139D of aperture plate 139 is inserted reliably in groove 241. Hence, aperture plate 139 pressure-contacts slope 242 reliably, thus providing hermetic compressor 1001 with further reliability.

This invention is not limited to this embodiment.

Industrial Applicability

A hermetic compressor according to the present invention does not produce fine metal powder when being manufactured, and has high reliability, thus being useful for a refrigerating apparatus, such as a home refrigerator, dehumidifier, refrigerated display case, and vending machine, operating in a refrigeration cycle.

The invention claimed is:

1. A hermetic compressor comprising:

a hermetic container arranged to store lubricating oil;

a motor element accommodated in the hermetic container;

a compressing element accommodated in the hermetic container, and driven by the motor element, wherein the compressing element includes a shaft rotatable by the motor element to compress refrigerant;

an oil-feeding mechanism provided in the shaft to carry the lubricating oil; and a centrifugal pump provided in the shaft and having an end with an opening positionable in the lubricating oil to pump the lubricating oil to the oil-feeding mechanism, wherein the centrifugal pump comprises a cylindrical portion having a hollow which opens at the opening, and an aperture plate having a suction aperture formed therein, the suction aperture having a cross-sectional area smaller than a cross-sectional area of the hollow, wherein the aperture plate has an inner periphery and an outer periphery, the inner periphery of the aperture plate defining the suction aperture, the outer periphery of the aperture plate contacting an inner surface of the cylindrical portion, and the aperture plate is waved in shape so as to curve out away from the cylindrical portion between the inner periphery and the outer periphery of the aperture plate.

2. The hermetic compressor according to claim 1, wherein the aperture plate is made of a plate having the suction aperture and having a concave surface and a convex surface opposite to the concave surface, the concave surface facing the hollow, and the plate is press-fixed to the opening.

3. The hermetic compressor according to claim 2, wherein a diameter of the aperture plate along the convex surface is larger than a diameter of the inner surface of the cylindrical portion.

4. The hermetic compressor according to claim 1, wherein the inner surface of the cylindrical portion has a groove formed therein into which the outer periphery of the aperture plate is inserted.

5. The hermetic compressor according to claim 4, wherein a diameter of the inner surface of the cylindrical portion at the opening is smaller than a diameter of the aperture plate along the waved surface thereof.

6. The hermetic compressor according to claim 4, wherein a width of the groove is larger than a thickness of the aperture plate.

7. The hermetic compressor according to claim 4, wherein the groove is defined by a sloped wall located on a side of the opening, and the sloped wall contacts the aperture plate.

8. The hermetic compressor according to claim 1, wherein the shaft is rotatable about a rotation axis, the shaft has a groove formed therein which constitutes part of the oil-feeding mechanism, and the hollow of the cylindrical portion of the centrifugal pump extends along a axis angled from the rotation axis of the shaft.

9. The hermetic compressor according to claim 1, wherein the aperture plate is made of one of a hot-rolled steel plate and a cold-rolled steel plate.

10. The hermetic compressor according to claim 1, wherein the shaft includes a main shaft and an eccentric shaft, and the compressing element further includes a bearing pivotally supporting the main shaft, and a cylinder block defining a compression chamber.

11. A method of manufacturing a hermetic compressor, comprising:

providing a hermetic container arranged to store lubricating oil;

accommodating a motor element in the hermetic container;

accommodating in the hermetic container a compressing element which includes a shaft rotatable by the motor element to compress refrigerant;

providing a centrifugal pump having an end with an opening positionable in the lubricating oil to carry the lubricating oil to the compressing element, the centrifugal pump comprising a cylindrical portion having a hollow which opens at the opening;

providing an aperture plate having an outer periphery and an inner periphery which defines a suction aperture formed in the aperture plate, the suction aperture having a cross-sectional area smaller than a cross-sectional area of the hollow, the aperture plate being generally curved to have convex and concave surfaces;

inserting the aperture plate to sit at the opening such that the concave surface of the aperture plate faces the hollow; and pressing the convex surface of the aperture plate toward the hollow so as to curve a center of the aperture plate into the hollow to thereby extend the aperture plate out in the opening and secure the outer periphery at the opening, while leaving the aperture plate curving out away from the cylindrical portion between the inner periphery and the outer periphery of the aperture plate.

12. The method according to claim 11, wherein the inner surface of the cylindrical portion has a groove formed therein, and inserting the aperture plate comprises inserting the outer periphery of the aperture plate in the groove.

* * * * *

UNITED STATES PATENT AND TRADEMARK OFFICE

CERTIFICATE OF CORRECTION

PATENT NO. : 8,157,545 B2
APPLICATION NO. : 12/515097
DATED : April 17, 2012
INVENTOR(S) : Takayuki Okamoto It is certified that error appears in the above-identified patent and that said Letters Patent is hereby corrected as shown below:

In the Claims

In column 7, claim 8, line 27, before "axis angled from the rotation" replace "a" with --an--.

Signed and Sealed this
Twenty-fourth Day of July, 2012

David J. Kappos

David J. Kappos
*Director of the United States Patent and Trademark Office*